US007150130B2

(12) United States Patent
Kobayashi et al.

(10) Patent No.: US 7,150,130 B2
(45) Date of Patent: Dec. 19, 2006

(54) SLIDING DOOR ASSEMBLY

(75) Inventors: Tetsuya Kobayashi, St-Georges (CA); Eric Gilbert, Beauceville (CA)

(73) Assignee: Portes Patio Resiver Inc., Beauceville (CA)

( * ) Notice: Subject to any disclaimer, the term of this patent is extended or adjusted under 35 U.S.C. 154(b) by 226 days.

(21) Appl. No.: 10/190,563

(22) Filed: Jul. 9, 2002

(65) Prior Publication Data

US 2003/0201071 A1 Oct. 30, 2003

(30) Foreign Application Priority Data

Apr. 30, 2002 (CA) ..... 2384213

(51) Int. Cl.
*E06B 1/04* (2006.01)

(52) U.S. Cl. ..... 52/210; 52/204.1; 52/204.54; 52/207; 52/213; 52/206.67; 52/656.7

(58) Field of Classification Search ..... 52/204.1, 52/204.51, 204.54, 204.597, 204.6, 207, 52/212, 209, 204.52, 204.67, 204.68, 204.69, 52/204.7, 656.7, 656.4; 49/501, 504, 505
See application file for complete search history.

(56) References Cited

U.S. PATENT DOCUMENTS

| | | | | | |
|---|---|---|---|---|---|
| 2,811,754 | A | * | 11/1957 | Toth | 49/316 |
| 2,913,046 | A | * | 11/1959 | Sharp et al. | 160/91 |
| 3,324,597 | A | * | 6/1967 | Samuel | 49/406 |
| 3,545,135 | A | * | 12/1970 | Lieber | 49/505 |
| 3,566,565 | A | * | 3/1971 | Pond | 52/208 |
| 3,815,285 | A | * | 6/1974 | Kuyper | 49/501 |
| 3,866,380 | A | | 2/1975 | Benson | |
| 3,899,258 | A | | 8/1975 | Matthews | |
| 4,219,971 | A | * | 9/1980 | Mauroner | 49/425 |
| 4,288,887 | A | | 9/1981 | Johnson et al. | |
| 4,351,131 | A | | 9/1982 | Kubik | |
| 4,398,373 | A | * | 8/1983 | Mancuso | 49/425 |
| 4,649,598 | A | * | 3/1987 | Kinsey et al. | 16/81 |
| 4,803,809 | A | * | 2/1989 | Takemura | 49/404 |
| 4,815,246 | A | * | 3/1989 | Haas | 52/207 |
| 4,944,118 | A | | 7/1990 | Biro | |
| 5,103,589 | A | * | 4/1992 | Crawford | 49/125 |
| 5,280,686 | A | * | 1/1994 | Davies | 49/209 |
| 5,692,349 | A | | 12/1997 | Guillemet | |
| 5,836,119 | A | | 11/1998 | Emmanuel | |
| 5,887,387 | A | * | 3/1999 | Dallaire | 49/408 |
| 6,244,000 | B1 | | 6/2001 | Bertolami | |
| 6,318,036 | B1 | | 11/2001 | Siudzinski et al. | |

* cited by examiner

*Primary Examiner*—Jeamette E. Chapman
(74) *Attorney, Agent, or Firm*—Ogilvy Renault LLP

(57) ABSTRACT

A door assembly of the type having a frame mounted to a wall. The frame comprises a head portion, opposed vertical jamb portions and a sill portion. Doors are provided in the frame. A door in the frame is displaceable between an open position and a closed position. The doors comprise a sash portion supporting a see-through panel. Each of the head portion, the jamb portion, the sill portion, and the sash portion of the door has one external cladding and one internal cladding. The external cladding and the internal cladding are detachably connected to one another, such that only the external cladding is exposed to an exterior of the door assembly and only the internal cladding is exposed to an interior of the door assembly when the door is in the closed position. A method for interconnecting two hollow elongated extruded sections of the door sash is also provided.

18 Claims, 7 Drawing Sheets

SLIDING DOOR ASSEMBLY

TECHNICAL FIELD

The present invention generally relates to sliding door assemblies and, more particularly, to a configuration of sliding door components, wherein the external cladding is formed of common components, as well as the internal cladding.

BACKGROUND ART

Sliding door assemblies are typically known as doors having a sash supporting a glass panel that covers a substantial portion of the door, with the sliding door slidingly mounted to a frame so as to slide with respect to the frame. Sliding door assemblies often include a sliding door and a fixed door mounted to a frame consisting of a head, a sill and jambs.

Aluminum is an elegant, light and resistant material that is readily extruded into complex sections, whereby it is a well suited material for at least an external cladding of a sliding door. However, a great disadvantage of the use of aluminum extruded sections for sliding doors is the high thermal conductivity of aluminum. Aluminum is an excellent heat conductor. In a cold climate, a sliding door sash solely consisting of aluminum sections can easily become very cold and thus cause condensation or ice formation on an interior surface of the sash or on the glass panel. Furthermore, the high thermal conductivity of aluminum causes high heat losses to sashes formed of aluminum sections.

Some sliding door assemblies incorporate numerous thermal breaks to improve the thermal insulation thereof. For example, various components are used to construct the frame and sashes to divide them into internal and external portions. For instance, some sliding door assemblies found on the market are constructed of four sections, including an external thermal cladding and an internal glass cladding in an insulated frame that consists of PVC extrusions. The insulating sections permit the use of aluminum sections, as they compensate, or isolate the highly conductive aluminum outer cladding.

The needs of consumers have evolved towards products of higher performance that remain simple in use, that are flexible and are esthetically appealing. Aluminum remains a well suited material for components constituting sliding doors. For instance, aluminum sections are resistant to deformation caused by climatic changes. However, where sliding doors are composed of numerous sections and the sliding doors are subjected to great temperature differentials between interior and exterior temperatures, the difference in expansion of the various components of a sliding door can result in the deformation thereof. Furthermore, differences in thermal expansion of components can cause damage to the seals of the sliding door and result in water infiltration and air leaks, and create problems in the sliding of the door with respect to the frame. Also, having numerous sections involves a greater number of components and requires more manpower for the assembly thereof because of the increased complexity.

There is also a need to provide a sliding door assembly with fewer component parts that are easy to assemble together and which provide for a variety of different claddings to suit the customer needs.

SUMMARY OF INVENTION

It is a feature of the present invention to provide an improved sliding door assembly.

It is a further feature of the present invention to provide a new method for assembling components of a sliding door assembly.

It is a still further feature of the present invention to provide a sliding door assembly having no visible fasteners.

It is a still further feature of the present invention to provide a corner connector for improving a connection between elongated members forming a sash.

According to the above feature of the present invention, from a broad aspect, the present invention provides a door assembly of the type having a frame mounted to a wall. The frame comprises a head portion, opposed vertical jamb portions and a sill portion. At least one door in the frame is displaceable between an open position and a closed position. The door comprises a sash portion supporting a see-through panel. Each of the head portion, the jamb portion, the sill portion, and the sash portion of the door has one external cladding and one internal cladding. The external cladding and the internal cladding are detachably connected to one another, such that only the external cladding is exposed to an exterior of the door assembly and only the internal cladding is exposed to an interior of the door assembly when the door is in the closed position.

According to a further broad aspect of the present invention, there is provided A method for interconnecting at least two hollow elongated extruded sections of a door sash, each hollow elongated section having at least one beveled mating end and at least an outer end wall defining thereagainst an internal hollow elongated channel, comprising the steps of i) inserting a first one of two arms of a right-angle connector in the internal hollow elongated channel of a first one of the hollow elongated sections from the beveled mating end thereof, the right-angle connector having in each arm an abutment protrusion disposed at a predetermined location and abutting an inner surface of the outer end wall; ii) inserting a second one of the arms of the right-angle connector in the internal hollow elongated channel of a second one of the hollow elongated sections from the beveled mating end thereof until the beveled mating ends of both hollow elongated sections abut one another; and iii) forming a crimp in the outer end wall of both hollow elongated sections at a predetermined location to form arresting shoulders under the abutment protrusions to interconnect the hollow elongated sections with a respective arm of the right-angle connector and with the beveled mating ends in contact with one another.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
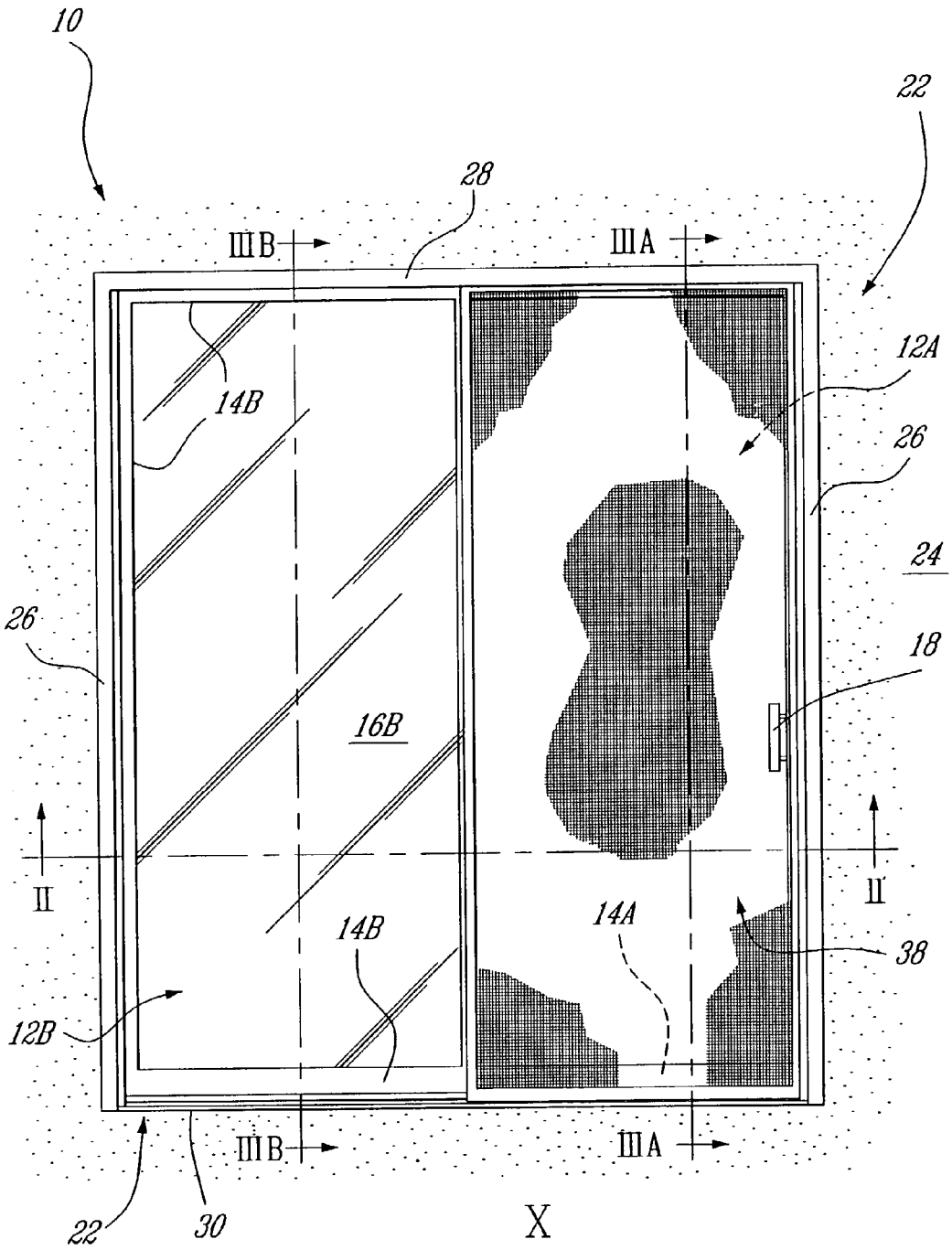
FIG. 1 is an exterior elevation view of a sliding door assembly constructed in accordance with the present invention.
Figure 2:
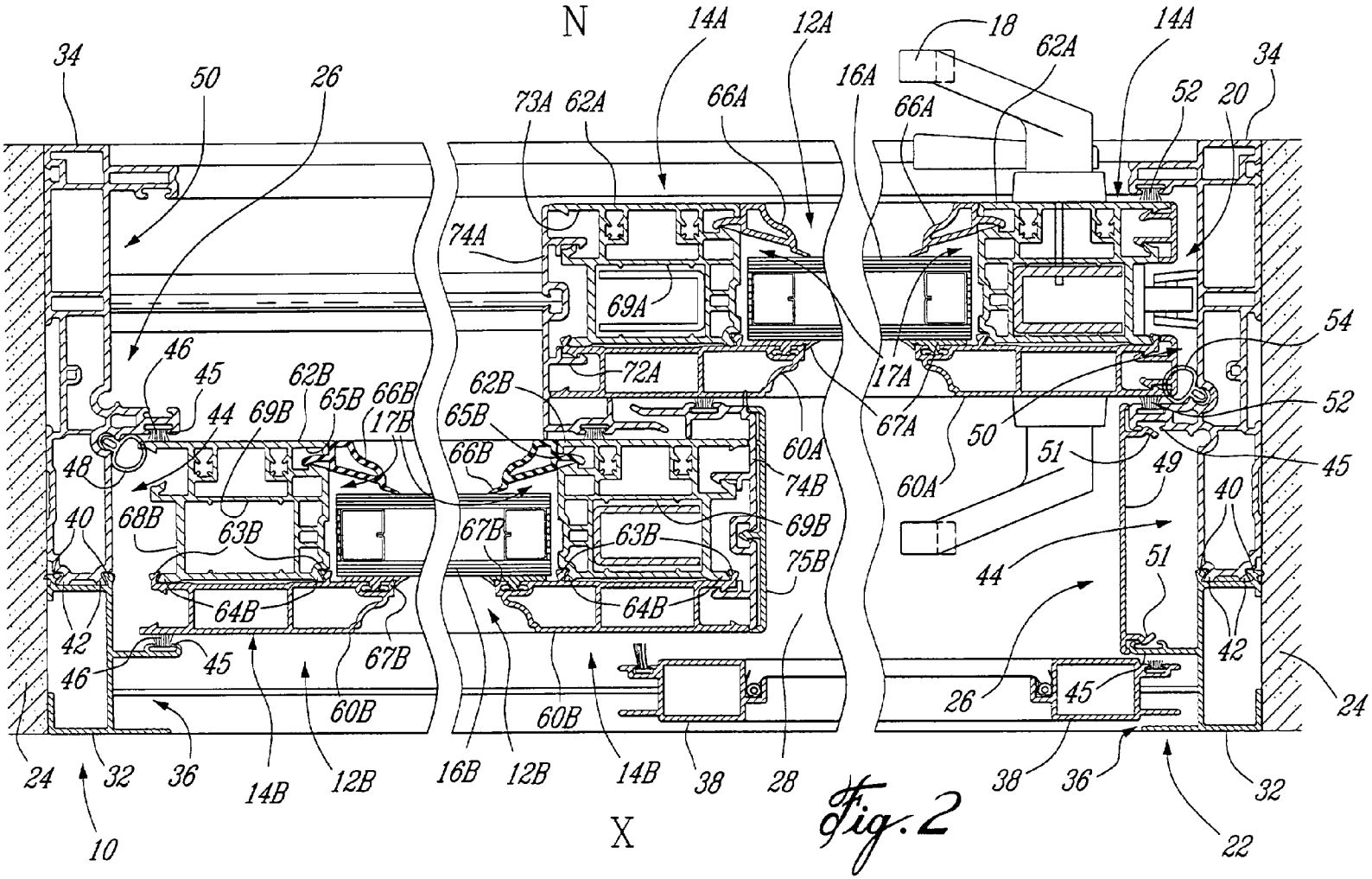
FIG. 2 is a fragmented cross-section view taken along cross-section line II–II of FIG. 1.

Referring to the drawings, and more particularly to FIG. 1, a sliding door assembly constructed in accordance with the present invention is generally shown at 10. The sliding door assembly 10 has a sliding door 12A, shown behind a screen stile 38, and a fixed door 12B. The sliding door 12A and the fixed door 12B generally comprise the same parts. For simplicity purposes, reference will be made to like elements of the sliding door 12A and the fixed door 12B without the letters "A" and "B" affixed thereto. However, the reference numerals on the drawings will have letters affixed thereto, namely "A" for parts of the sliding door 12A and "B" for parts of the fixed door 12B. The doors 12 typically consist of a sash 14 supporting a glass panel 16. The sliding door 12A has a handle 18 on an interior and an exterior side thereof, as best shown in FIG. 2. The handle 18 incorporates a locking system 20 that will lock the sliding door 12A to a frame 22 of the sliding door assembly 10.

Referring to FIG. 1, the sliding door assembly 10 is secured in a wall 24 by its frame 22. The frame 22 generally consists of jambs 26, a head 28 and a sill 30. The sliding door 12A is held in the frame 22 so as to translate along the head 28 and the sill 30 on rails. On the other hand, the fixed door 12B is fixed in position to one of the jambs 26 and a portion of the head 28 and the sill 30. Therefore, the sliding door 12A translates between a closed position, as shown in FIG. 1, and an open position (not shown), but well known in the art.

In the sliding door assembly 10 of the present invention, the sashes 14, the jambs 26, the head 28 and the sill 30 each consist of an external cladding and an internal cladding. The external cladding is formed of a material that is weather-resistant and capable of sustaining high temperature differentials. For instance, aluminum extruded sections are well suited to form the external cladding of the above-mentioned parts of the sliding door assembly 10. On the other hand, the internal cladding will provide the thermal insulation to the above-cited parts of the sliding door assembly 10. As the external cladding is preferably constructed of aluminum sections, which has a relatively high thermal conductivity, the internal cladding will ensure that the overall thermal conductivity of the sliding door assembly 10 is reduced. Furthermore, only the internal cladding will be visible from the inside of the sliding door, such that the interior finish of the sliding door assembly 10 will be independent of the external cladding. As each part of the sliding door assembly 10, aside from the glass panels 16, has an internal cladding, it will be possible to have a uniform finish on an interior of the sliding door assembly 10. PVC and high- and low-density polyurethane are well suited materials for the internal cladding of the sliding door assembly 10. These materials have the advantage of being extruded, whereby they can have hollow cavities in their cross-sections. These cavities define air pockets that act as insulation. Wood trims or insulated aluminum can also be used for the internal cladding.

Figure 3A:
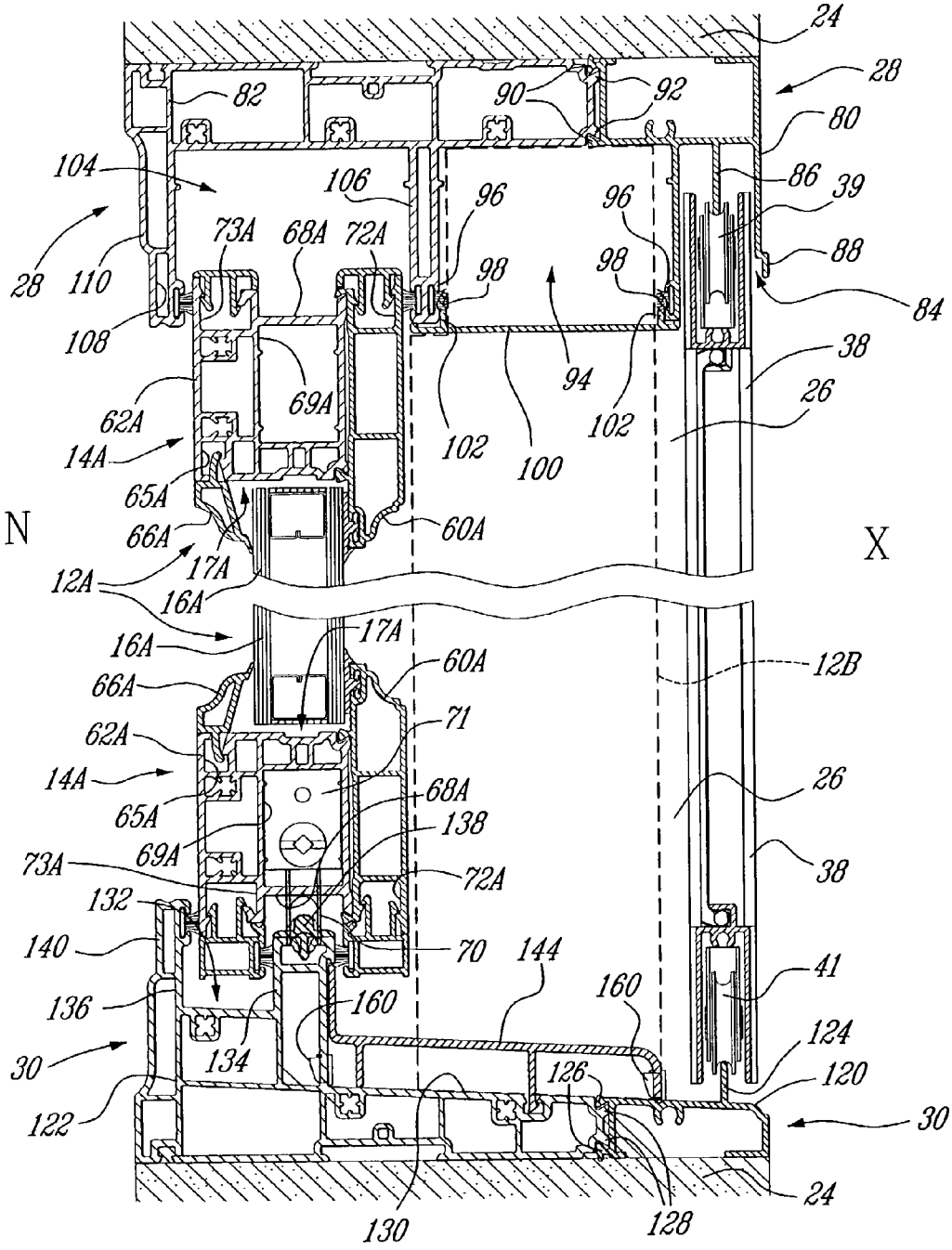
FIG. 3A is a fragmented cross-section view taken along cross-section line IIIA–IIIA of FIG. 1.
Figure 3B:
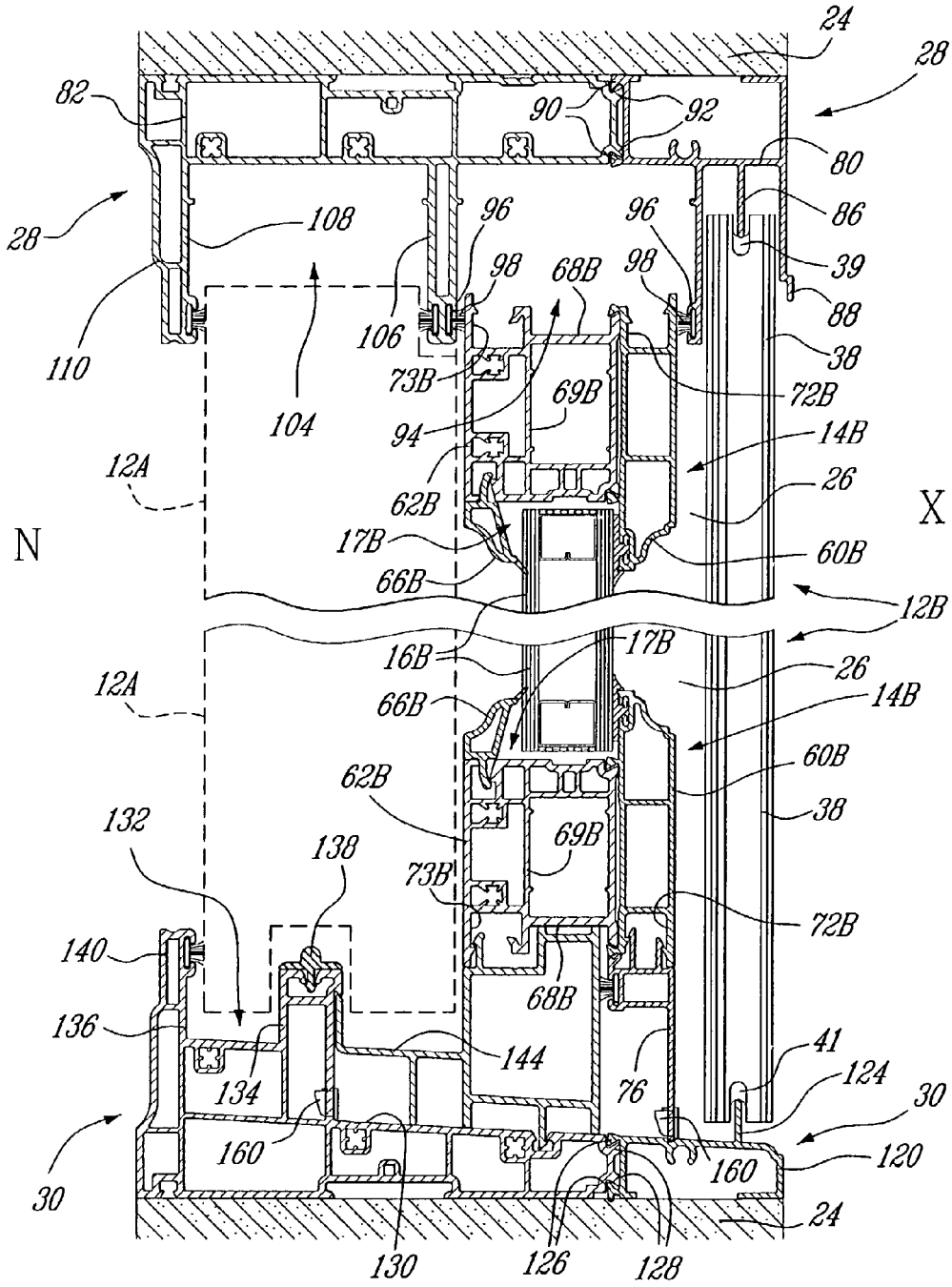
FIG. 3B is a fragmented cross-section view taken along cross-section line IIIB–IIIB of FIG. 1.

Referring to FIGS. 2, 3A and 3B, cross-sectional views of the sliding door assembly 10 are shown, with an exterior designated by X, and an interior indicated by N. As mentioned previously, all components of the jambs 26, head 28, sill 30 and sashes 14 of the sliding door assembly 10 will expose an external cladding on the side of the exterior X, and an internal cladding on the side of the interior N.

More specifically, referring to FIG. 2, the jambs 26 are shown having an exterior section 32, constituting the exterior jamb surface and the external cladding, and an interior section 34, constituting the interior jamb surface and the internal cladding. As mentioned previously the exterior section 32 is preferably an aluminum section, whereas the interior section 34 is the thermal insulation section. The exterior section 32 and the interior section 34 are the same for both jambs 26. The exterior section 32 defines a vertical channel 36 so as to receive ends of the screen stile 38 of the sliding door assembly 10. The vertical channels 36 of both jambs 26 are positioned face to face such that the screen stile 38 may be received in one or the other of the vertical channels 36, depending on whether the screen stile 38 is in an open or a closed position. In FIG. 2, the screen stile 38 is in its closed position, as it covers the openable side of the sliding door assembly 10.

The exterior sections 32 have connection fingers 40 for engagement with corresponding connection fingers 42 of the interior sections 34. On both of the jambs 26, the exterior section 32 and the interior section 34 combine to define fixed door receiving channels 44. One of the fixed door receiving channels 44 will receive a lateral portion of the fixed door 12B. Weather strips 46 ensure the sealing between the fixed door 12B and the fixed door receiving channel 44. As the fixed door 12B is immovable, one of the fixed door receiving channels 44 will not receive the fixed door 12B, whereby it is covered with a finish cap 49. The finish cap 49 has connection fingers 51 that engage with corresponding connection fingers 45 of the fixed door receiving channel 44. It is pointed out that the connection fingers 45 are also used to secure the weather strips 46.

The interior sections 34 each further define a sliding door receiving channel 50 for receiving lateral portions of the sliding door 12A. The sliding door receiving channel 50 that receives the sliding door 12A in its closed position has weather strips 52 and a seal 54. Accordingly, when the sliding door 12A is in its closed position in the corresponding sliding door receiving channel 50, the weather strips 52 ensure the airtight and watertight engagement therebetween. This sliding door receiving channel 50 receives a portion of the locking system 20 such that the sliding door 12A may be locked to the jamb 26 in the closed position. The exterior section 32 and interior section 34 of the jambs 36 are readily secured to the wall 24 with known fasteners, such as screws (not shown) that extend through the exterior section 32 and the interior section 34. The interior section 34 consists of numerous closed air pockets that will increase the thermal insulation of the jambs 26.

Referring now to FIGS. 3A and 3B, the head 28 is shown having an exterior section 80, constituting the external cladding, and an interior section 82, constituting the internal cladding of the head 28. Similarly to the configuration of the jambs 26, the exterior section 80 is preferably an aluminum extruded section, whereas the interior section 82 is the thermal insulation section. The exterior section 80 defines a horizontal channel 84 that will receive an upper end of the screen stile 38. A rail 86 is generally positioned in the middle of the horizontal channel 84, so as to provide upper rollers 39 of the screen stile 38 with a rolling surface. A front lip 88 of the exterior section 80 projects downwardly below an upper edge of the screen stile 38 to protect the latter from the weather.

The exterior section 80 has connection fingers 90 for engagement with corresponding connection fingers 92 of the interior section 82. The exterior section 80 and the interior section 82 combine to define a fixed door receiving channel 94 that will receive an upper portion of the fixed door 12B. The fixed door receiving channel 94 has connection fingers 96 to hold weather strips 98 that will seal the fixed door 12B to the fixed door receiving channel 94. As the fixed door 12B is immovable, a portion of the fixed door receiving channel 94 is closed with a finish cap 100 that has connection fingers 102 corresponding to the connection fingers 96 of the fixed door receiving channel 94. It is pointed out that the finish cap 100 has the same cross-section as the finish cap 49 used with the jambs 26, whereby only one extrusion die is required to produce both. As mentioned previously, the finish caps 49 and 100 preferably consist of an aluminum section.

The interior section 82 further defines a sliding door receiving channel 104 for receiving an upper portion of the sliding door 12B. The sliding door receiving channel 104 must keep the sliding door 12B in vertical position, whereby the walls 106 and 108 defining the sliding door receiving channel 104 must be rigid. Furthermore, the wall 108 has a finish surface 110, which is the sole portion of the head 28 that is fully visible from the interior N. A portion of the sliding door receiving channel 104, which is a portion of the head 28, is partly visible depending on the position of the sliding door 12A in the frame 22.

The exterior section 80 and the interior section 82 of the head 28 are readily secured to the wall 24 with known fasteners, such as screws (not shown) that extend through the exterior section 80 and the interior section 82. The interior section 82 consists of numerous closed air pockets or cavities that will increase the thermal insulation of the head 28.

Referring to FIGS. 3A and 3B, the sill 30 is shown having an exterior section 120, constituting the external cladding, and an interior section 122, constituting the internal cladding of the sill 30. Similarly to the configuration of the jambs 26 and the head 28, the exterior section 120 is preferably an aluminum extruded section, whereas the interior section 122 is the thermal insulation section. The exterior section 120 defines a horizontal rail 124 that will support and guide the screen stile 38. The horizontal rail 124, the screen stile 38 and the rail 86 of the head 28 are coplanar such that the screen stile 38 can translate in the frame 22 of the sliding door assembly 10. The screen stile 38 has rollers 41 that will roll on the horizontal rail 124. The exterior section 120 has connection fingers 126 for engagement with corresponding connection fingers 128 of the interior section 122. The exterior section 120 and the interior section 122 combine to define a sloped surface 130, sloping downwardly from the interior N and to the exterior X. The interior section 122 defines a sliding door receiving channel 132 that is defined by walls 134 and 136. The wall 134 receives a rail 138 on an upper edge thereof for supporting and guiding rollers 70 of the sliding door 12A. The wall 136 has a finish surface 140, which is the sole portion of the sill 30 that is fully visible from the interior N. The surface of the sliding door receiving channel 132, which is a portion of the sill 30, and a portion of the fixed door support 142 are also partly visible depending on the position of the sliding door 12A in the frame 22.

Referring to FIG. 3B, the sloped surface 130 is shown securing a fixed door support 142 that will support the fixed door 12B. The fixed door support 142 only covers the portion of the sill 30 below the fixed door 12B. The fixed door support 142 is preferably a thermal insulation section, as it is partly exposed to the interior N of the sliding door assembly 10.

Referring to FIG. 3A, the sloped surface 130 is shown securing a sill cover 144, which will also have a sloped surface slanting from the interior N to the exterior X. The sill cover 144 is preferably of aluminum, as it is on the exterior X of the sliding door assembly 10. The sill cover 144 and the interior section 122 of the sill 30 are provided with check valves 160 that will facilitate the draining of water infiltrated in the air pockets defined by the sill cover 144 and in the sliding door receiving channel 132, the water infiltration being caused by a pressure differential between the interior N and the exterior X.

The check valves 160 are initially closed. The check valves 160 only open when the gravity of water accumulated is higher than the exterior pressure and/or a dynamic pressure differential is applied on the sliding door assembly 10. Because of both internal and external check valves 160, the pressure in the air pocket of the sill cover 144 is generally between the interior pressure and the exterior pressure. The check valves 160 help to reduce a pressure differential between the interior and the exterior, while ensuring that the sill 30 is watertight.

Water that flows on an exterior surface of the sliding door assembly 10 will drain externally on the sill cover 144. The water infiltrated into the air pockets defined by the sill cover 144 and into the sliding door receiving channel 132 will drain internally (i.e., via the check valves 160). The internal and the external drainage system of check valves 160 will facilitate the draining of water, and this will reduce the accumulation of water in or on the sill 30.

Similarly, referring to FIG. 3B, the interior section 122 and the weather strip connector 76 also have check valves 160, to drain liquid accumulated in the fixed door support 142.

Figure 4:
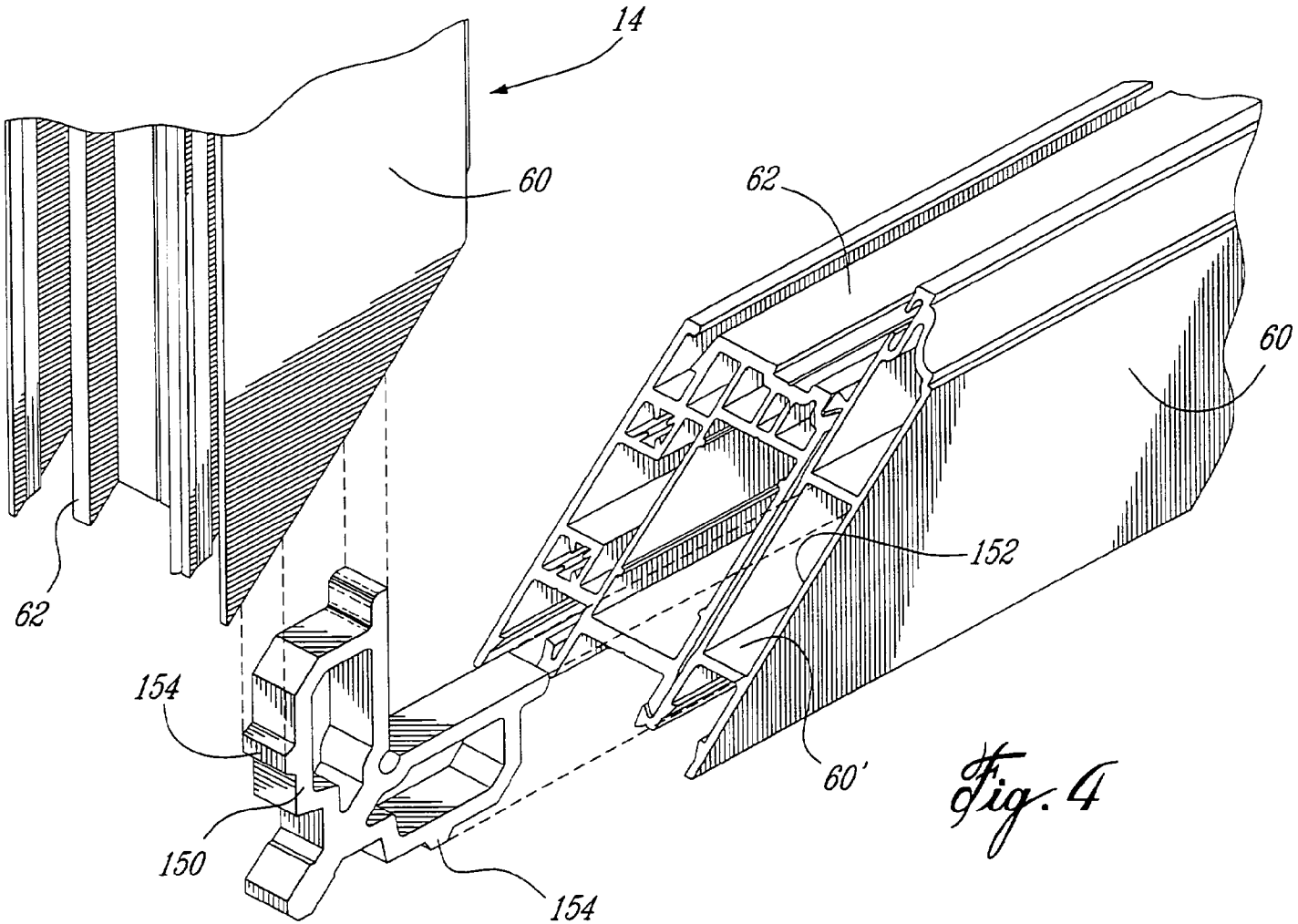
FIG. 4 is an enlarged and fragmented exploded view of a corner connector for assembling sash members of the present invention.

Referring to FIGS. 2, 3A and 3B and as mentioned previously, the doors 12 each consist of a sash 14 supporting a glass panel 16. Each sash 14 is formed of four elongated extruded members. As seen in FIG. 4, a pair of elongated extruded members are shown having oblique ends to be joined. Each of the elongated members consists of an exterior section 60, constituting the external cladding, and an interior section 62, constituting the internal cladding. Once more, the exterior section 60 is preferably an aluminum section, while the interior section 62 is the thermal insulation section, usually a PVC or polyurethane extruded section. It is pointed out that an important feature of the sliding door assembly 10 is that the exterior sections 60 and the interior sections 62 of each elongated member each have the same cross-section, such that only one die is required for the extrusion of the exterior sections 60, and only one die mold is required for the extrusion of the interior sections 62.

The exterior section 60 has connection fingers 63, and the interior section 62 has corresponding connection fingers 64, such that the exterior section 60 and the interior section 62 can be interconnected. A channel 65 is provided on the inner periphery of the interior section 62 so as to receive a glazing bead 66. The glazing bead 66 forms a glass panel receiving channel 17 with a projection portion 67 of the exterior section 60, for receiving and securing the glass panel 16 with the use of glazing tape or a glazing gasket.

An outer periphery of the interior section 60 has a peripheral channel 68. A cavity 69 is opposite the peripheral channel 68 in the interior section 62. This configuration provides numerous functions to the elongated extruded members. For instance, as shown in FIG. 3A, a roller mechanism 71 having the rollers 70 is partly received in the cavity 69, while the rollers 70 extend through the peripheral channel 68 to engage with the rail 138 of the sill 30. Connection slots 72 and 73 are provided on each side of the peripheral channel 68, in the exterior section 60 and the interior section 62, respectively. As shown in FIG. 2, the connection slots 72 and 93 receive various finish caps 74 and 75, or, as shown in FIG. 3B, weather strip connectors 76. It is pointed out that the weather strip connector 76 hides the fixed door support 142 and is of aluminum, such that the fixed door support 142, consisting of the same material as the internal cladding components, is not exposed to the exterior X. Similarly, as illustrated in FIG. 2, the finish cap 75B, consists of aluminum, such that the interior section 62B of the fixed door 12B is not exposed to the exterior. As shown in FIG. 2, the cavity 69 also encloses a portion of the locking system 20.

The assembly of the external cladding to the internal cladding in the sashes 14, the jambs 26, the head 28 and the sill 30 is greatly simplified by the use of corresponding connection fingers. Accordingly, all parts of the external cladding can be connected to a corresponding part of internal cladding without fasteners, for instance by sliding one part into the other, or by snapping one part to another. The internal cladding components may be changed in order to change the interior finish of the sliding door assembly 10. It is noted that the external and internal cladding of the sashes is free of fasteners, whereby no fasteners are seen from the outside. The claddings should also be easy to remove.

Figure 5:
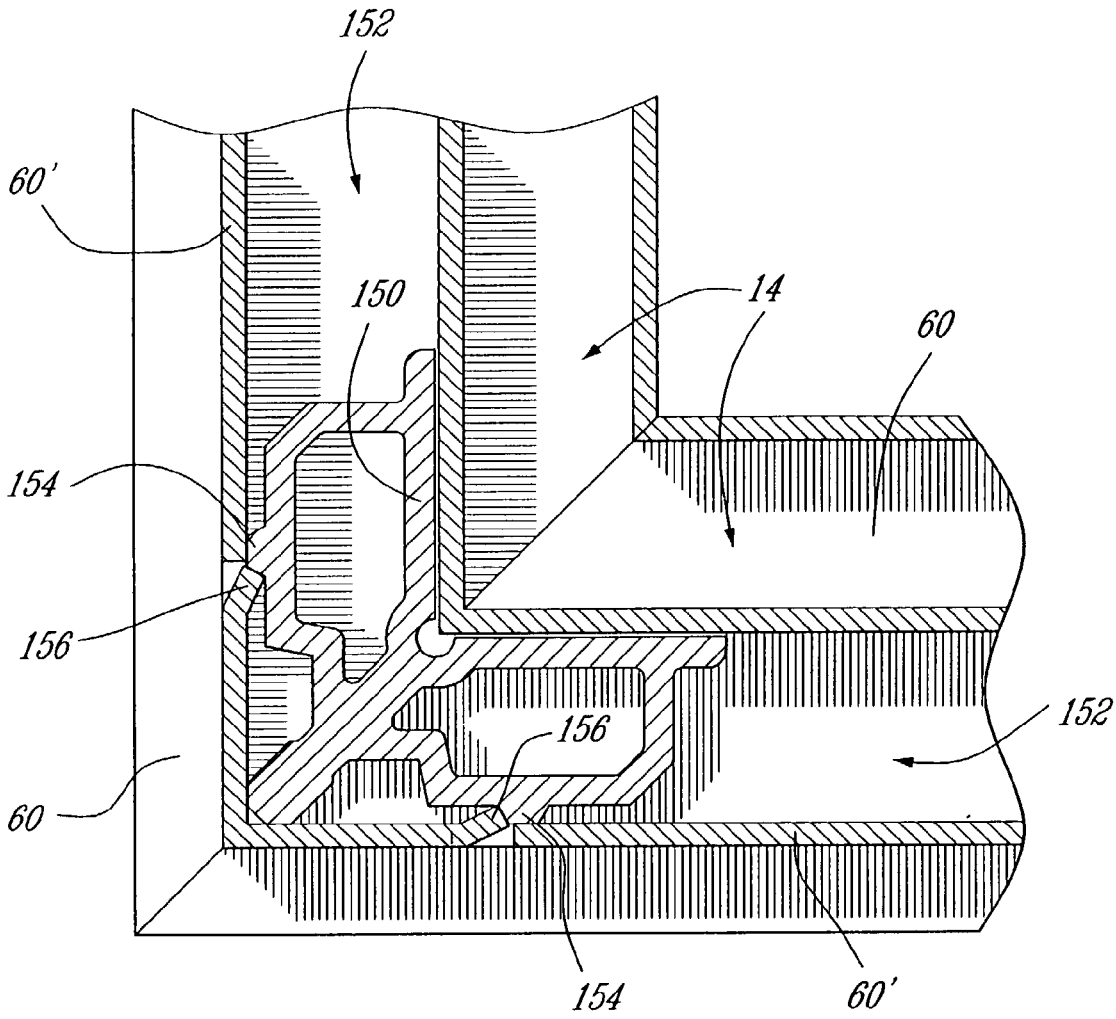
FIG. 5 is a longitudinal section view illustrating the corner connector connecting sash members together.

As shown in FIGS. 4 and 5, the exterior sections 60 have beveled ends so as to be transversely connected to one another. A corner connector 150 has opposed ends thereof received in cavities 152 of the exterior sections 60. The corner connector 150 has protrusions 154 on an outer edge surface thereof, and is sized such that the protrusions 154 abut against a surface of a longitudinal wall 60' within the cavities 152. As shown in FIG. 5, the exterior sections 60 are readily interconnected when mated together by the connector 150 by crimping a wall portion 156 in the longitudinal walls 60' of the exterior sections 60. The crimp wall portion 156 under the protrusions 154 ensure that the exterior extruded sections 60 remain connected one to the other. It is also pointed out that the crimp portion 156 is concealed and thus not visible exteriorly.

Figure 6B:
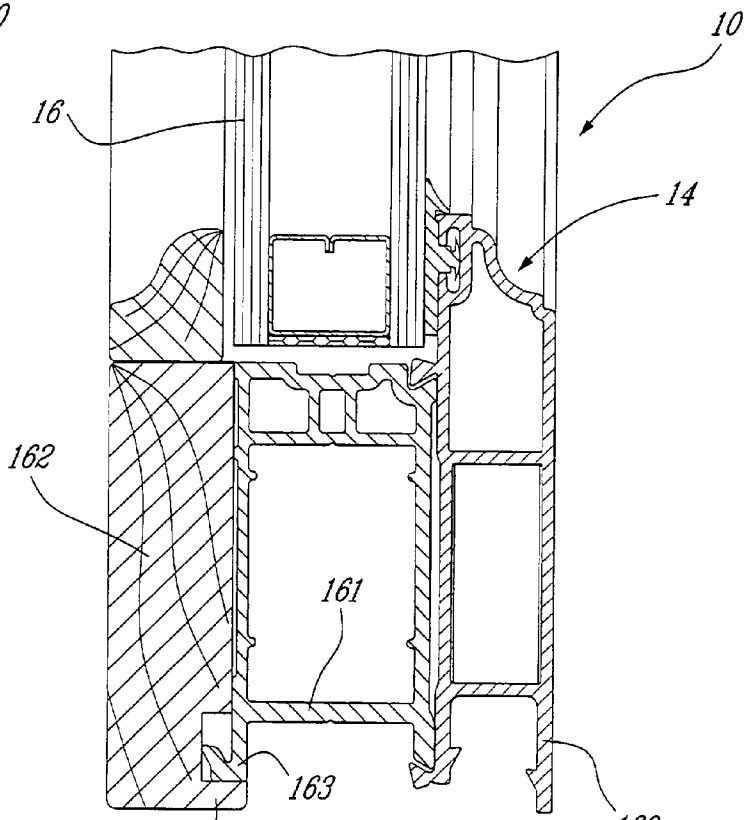
FIG. 6B is a cross-section view of a sash still constructed in accordance with another embodiment of the present invention.
Figure 6A:
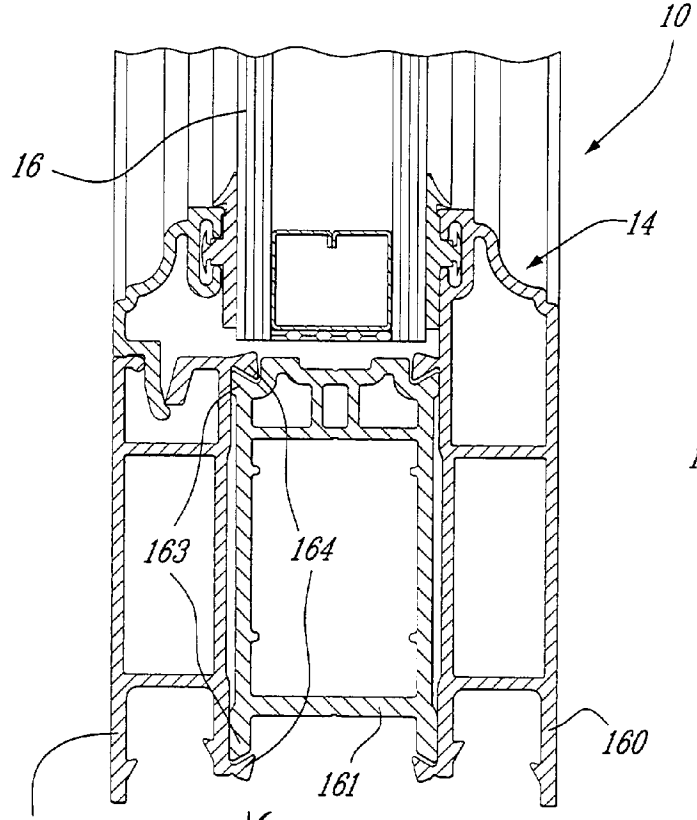
FIG. 6A is a cross-section view of a sash constructed in accordance with another embodiment of the present invention.

Referring to FIGS. 6A and 6B, another embodiment of the present invention is illustrated, wherein the sliding door assembly 10 has the sashes, the jambs, the head and the sill each consisting of an external cladding, an internal cladding, and an intermediate cladding therebetween. More specifically, the sash 14 is shown having an exterior section 160 constituting the external cladding, an intermediate section 161 constituting the intermediate core, and an interior section 162 constituting the internal cladding. The intermediate core is the thermal insulation section, and allows the use of internal cladding that are not restricted to low thermal conductivity material. The internal cladding is thus chosen for the finishing it provides. For instance, aluminum sections, as illustrated in FIG. 6A, and thin wood sections, as illustrated in FIG. 6B, can be used as the interior section 162. Such variety of internal cladding 162 provides an added value to the look of the sliding door assembly 10 as there are no visible fasteners from the interior N or the exterior X of the sliding door assembly 10, similarly as with the previous embodiment.

Although the use of an external cladding and an internal cladding has been described for sliding door assemblies, it is obvious that other types of doors can also use such construction. For instance, typical hinged doors and garden doors can advantageously be formed of an external cladding and an internal cladding as herein described.

It is within the ambit of the present invention to cover any obvious modifications of the preferred embodiment described herein, provided such modifications fall within the scope of the appended claims.

The invention claimed is:

1. A door assembly of the type having a frame mounted to a wall, the frame having a head portion, opposed vertical jamb portions and a sill portion, at least one door in the frame displaceable between an open position and a closed position, the door having a sash portion supporting a see-through panel, the door assembly comprising:

one external cladding and one internal cladding being detachably connected to one another, for each of:

the head portion of the frame;

the jamb portion of the frame;

the sill portion of the frame; and the sash portion of the door;

such that only the external cladding is exposed to an exterior of the door assembly and only the internal cladding is exposed to an interior of the door assembly when the door is in the closed position.

2. The door assembly according to claim 1, wherein at least one of the external cladding and the internal cladding of at least one of the jamb portions and the sash portion are formed of elongated members having a common cross section.

3. The door assembly according to claim 2, wherein the external cladding consists of extruded sections.

4. The door assembly according to claim 2, wherein the internal cladding is formed of at least one of extruded polyvinyl chloride, extruded polyurethane, wood components and insulated aluminum.

5. The door assembly according to claim 2, wherein the elongated extruded members having a common cross section are extruded with a same die.

6. The door assembly according to claim 1, comprising two doors, a first one of the doors being fixed to the frame and a second one of the doors being displaceable in translation in the frame between an open position and a closed position.

7. The door assembly according to claim 1, wherein the external cladding and the internal cladding are interconnected without the use of fasteners visible from at least one of the exterior and the interior of the door assembly.

8. The door assembly according to claim 3, wherein the extruded sections of the sash portion have beveled ends for perpendicular connection between the extruded sections.

9. The door assembly according to claim 8, wherein the aluminum extruded sections are interconnected by a connector received in cavities of the extruded sections and crimped thereto.

10. The door assembly according to claim 9, wherein gaps are provided in the connector adjacent contact surfaces between an outer periphery of the connector and a wall of the cavities of the extruded sections, for receiving a crimped portion of the extruded sections.

11. The door assembly according to claim 10, wherein crimping portions of the extruded sections are positioned on an outer periphery of sash portion not to be visible.

12. The door assembly according to claim 1, wherein the internal cladding and the external cladding define closed cavities, the internal cladding and the external cladding being provided with unidirectional flow valves between closed cavities such that fluid having infiltrated the closed cavities is drained to an exterior of the door assembly.

13. The door assembly according to claim 1, further comprising an intermediate core between the internal cladding and the external cladding, the intermediate core connecting the internal cladding to the external cladding without fasteners visible from at least one of the exterior and the interior of the door assembly.

14. The door assembly according to claim 13, wherein the external cladding consists of extruded aluminum sections, the intermediate core is selected from a group consisting of at least one of extruded polyvinyl chloride, extruded polyurethane, and insulated aluminum, and the internal cladding is selected from a group consisting of at least one of extruded aluminum sections, wood components and extruded polyvinyl chloride.

15. The door assembly according to claim 13, wherein the intermediate core has a lower thermal conductivity than the external cladding.

16. The door assembly according to claim 3, wherein the extruded sections of the external cladding consists of extruded aluminum sections.

17. The door assembly according to claim 1, wherein the external cladding has first connection fingers extending toward an interior, and the internal cladding has second connection fingers extending toward an exterior, for cooperating engagement between the first connection fingers and second connection fingers when the first cladding and the second cladding are detachably connected.

18. A door assembly of the type having a frame mounted to a wall, the frame comprising a head portion, opposed vertical jamb portions and a sill portion, at least one door in the frame displaceable between an open position and a closed position, the door comprising a sash portion supporting a see-through panel, wherein each of the head portion, the jamb portion, and the sill portion of the frame, and the sash portion of the door has one external cladding and one internal cladding, the external cladding and the internal cladding being detachably connected to one another, such that only the external cladding is exposed to an exterior of the door assembly and only the internal cladding is exposed to an interior of the door assembly when the door is in the closed position, wherein the internal cladding and the external cladding define closed cavities, the internal cladding and the external cladding being provided with unidirectional flow valves between closed cavities such that fluid having infiltrated the closed cavities is drained to an exterior of the door assembly.

* * * * *